US009151085B2

(12) United States Patent
Papanikolaou et al.

(10) Patent No.: US 9,151,085 B2
(45) Date of Patent: Oct. 6, 2015

(54) PASSIVE ENTRY SIDE DOOR LATCH RELEASE SYSTEM

(75) Inventors: Kostandinos D. Papanikolaou, Huntington Woods, MI (US); James J. Loschiavo, Livonia, MI (US); Timothy O. Goodchild, Canton, MI (US); Venkatesh Krishnan, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 912 days.

(21) Appl. No.: 11/164,369

(22) Filed: Nov. 21, 2005

(65) Prior Publication Data

US 2007/0126243 A1 Jun. 7, 2007

(51) Int. Cl.

| | |
|---|---|
| ***E05C 3/06*** | (2006.01) |
| ***E05B 81/24*** | (2014.01) |
| ***E05B 81/06*** | (2014.01) |
| ***E05B 79/20*** | (2014.01) |
| ***E05B 81/34*** | (2014.01) |
| *E05C 3/16* | (2006.01) |
| *E05B 15/00* | (2006.01) |
| *E05B 77/30* | (2014.01) |

(52) U.S. Cl.

CPC ..... *E05B 81/25* (2013.01); *E05B 79/20* (2013.01); *E05B 81/06* (2013.01); *E05B 81/34* (2013.01); *E05B 15/004* (2013.01); *E05B 77/30* (2013.01); *Y10T 292/1082* (2015.04)

(58) Field of Classification Search

USPC ..... 292/201, 216, DIG. 23

See application file for complete search history.

(56) References Cited

U.S. PATENT DOCUMENTS

| | | | | | |
|---|---|---|---|---|---|
| 4,702,117 | A | * | 10/1987 | Tsutsumi et al. | 74/89.17 |
| 4,848,031 | A | * | 7/1989 | Yamagishi et al. | 49/280 |
| 4,929,007 | A | * | 5/1990 | Bartczak et al. | 292/336.3 |
| 5,618,068 | A | * | 4/1997 | Mitsui et al. | 292/201 |
| 5,632,515 | A | * | 5/1997 | Dowling | 292/216 |
| 5,921,612 | A | * | 7/1999 | Mizuki et al. | 296/155 |
| 6,125,583 | A | * | 10/2000 | Murray et al. | 49/291 |
| 6,361,091 | B1 | | 3/2002 | Weschler | |
| 6,470,719 | B1 | | 10/2002 | Franz et al. | |
| 6,523,376 | B2 | | 2/2003 | Baukholt et al. | |
| 2004/0195845 | A1 | | 10/2004 | Chevalier | |

* cited by examiner

*Primary Examiner* — Mark Williams

(74) *Attorney, Agent, or Firm* — Raymond Coppiellie; Price Heneveld LLP

(57) ABSTRACT

A vehicle passive entry side door latch release system engageable with a release cable connected a door latch. The door latch release system may include a movable linkage assembly engageable with the release cable, a motor including an output shaft having a pinion engageable with a rack affixed to or formed with the linkage assembly to move the release cable to unlatch the door latch, and an electronic control unit for controlling the motor. The electronic control unit may operate the motor upon receiving an actuation signal. The invention also provides a vehicle including the door latch release system described above, and various embodiments thereof.

12 Claims, 7 Drawing Sheets

PASSIVE ENTRY SIDE DOOR LATCH RELEASE SYSTEM

BACKGROUND OF INVENTION a. Field of Invention

The invention relates generally to vehicle door latch release systems, and, more particularly, to a vehicle passive entry side door latch release system that can operate with existing door latch assemblies.

b. Description of Related Art

In recent years, automatic vehicle door latch release systems have become increasingly popular and are now available in a variety of new automobiles. Such door latch release systems normally operate by sending an electrical signal to a latch release unit when an operator either pulls an outside door handle, depresses an actuation switch underneath or adjacent the handle, or otherwise approaches the vehicle with a remote access unit. Once the outside handle is pulled or otherwise actuated, the latch release unit must release the latch or otherwise unlock the door within 50 ms or less to enable seamless operation of the latch release (or unlocking) and door opening functions.

More specifically, the operation of a typical passive latch release system is initiated when a user carrying a remote transmitter (i.e. a key fob) approaches a vehicle. The latch release system is thus activated upon the user's approach and verifies an encoded signal sent by the remote transmitter to activate the system. The latch release system then authenticates the encoded signal and performs a series of functions for allowing the user to open the door.

Such an exemplary passive latch release system is disclosed for example in U.S. Patent App. No. 2004/0195845 to Chevalier. Referring to FIGS. 1-3 of Chevalier, the latch arrangement (100) includes an electric motor (34) controlled by an electronic control unit (7) and further includes a plurality of actuators (700, 800) arranged to release, lock and/or unlock the latch to a vehicle door. The electronic control unit (7), which controls motor (34) to release, lock and/or unlock the latch, is responsive to movement of an external manual actuator for allowing the door to be opened.

As readily evident, latch release systems, such as the system disclosed by Chevalier, thus require a relatively complex latch release assembly for actuating a door latch via the outside door handle or otherwise via a remote unit. However, for existing conventional latch release systems which generally include an outside door handle and latch rod assembly for operating a door latch from the outside of a vehicle, and an inside door handle and release cable assembly for operating the door latch from the inside of a vehicle, the noted Chevalier passive latch release system is inoperable without removal and replacement of the existing latch release assembly. As readily evident, while such removal and replacement of the existing latch release assembly may be performed on a limited basis, it would be beneficial to have a door latch release system which is operable with existing latch release assemblies while minimizing the time and expense of modifying or otherwise replacing an existing assembly for automatic latch release operation.

Accordingly, there remains a need for a door latch release assembly, which is economical to manufacture, install and service, in vehicles with existing conventional latch release assembly designs, as well as in vehicles where the latch release or door unlock assembly is operable by pulling one or more release cables. There also remains a need for a door latch release assembly which is robust in design for long term use in a variety of vehicles, which reduces design and tooling costs, and which further meets automotive fit and operation requirements for such components.

SUMMARY OF INVENTION

The invention solves the problems and overcomes the drawbacks and deficiencies of prior art passive door latch release systems by providing a vehicle passive entry side door latch release system engageable with a release cable connected to a door latch. The door latch release system may include a movable linkage assembly engageable with the release cable, a motor including an output shaft having a pinion engageable with a rack affixed to or formed with the linkage assembly to move the release cable to unlatch the door latch, and an electronic control unit for controlling the motor. The electronic control unit may operate the motor upon receiving an actuation signal.

For the door latch release system described above, the linkage assembly may include one or more apertures for insertion and retention of the release cable. The linkage assembly may also be spring biased towards the release cable to maintain the door latch in a latched configuration.

The invention also provides a vehicle passive entry side door latch release system engageable with a first release cable connected to an inside door handle and with a second release cable connected to a door latch. The door latch release system may include a movable linkage assembly engageable with the first and second release cables, means for moving the linkage assembly to move the second release cable to unlatch the door latch, and means for controlling the means for moving. The means for controlling may operate the means for moving upon receiving an actuation signal.

For the door latch release system described above, in an exemplary embodiment, the means for moving may be a motor including an output shaft having a pinion engageable with a rack affixed to or formed with the linkage assembly for moving the second release cable. Alternatively, the means for moving may be a rotary solenoid engageable with the linkage assembly for moving the second release cable, or a solenoid including a movable shaft engageable with the second release cable for moving the second release cable. Yet further, the means for moving may be a linear actuator including a movable shaft engageable with the second release cable for moving the second release cable. The linkage assembly may include one or more respective apertures for insertion and retention of each of the first and second cables. The linkage assembly may also be spring biased towards the second release cable to maintain the door latch in a latched configuration. The actuation signal may be provided by movement of an outside door handle, actuation of a switch adjacent the outside door handle, and/or a remote actuation unit, and/or other means known in the art.

The invention yet further provides a vehicle including a passive entry side door latch release system engaged with a first release cable connected to an inside door handle and with a second release cable connected to a door latch. The door latch release system may include a movable linkage assembly engaged with the first and second release cables, means for moving the linkage assembly to move the second release cable to unlatch the door latch, and means for controlling the means for moving. The means for controlling may operate the means for moving upon receiving an actuation signal.

For the vehicle including the door latch release system described above, the means for moving may be a motor including an output shaft having a pinion engaged with a rack affixed to or formed with the linkage assembly for moving the second release cable. Alternatively, the means for moving may be a rotary solenoid engaged with the linkage assembly for moving the second release cable, or a solenoid including a movable shaft engaged with the second release cable for moving the second release cable. Yet further, the means for moving may be a linear actuator including a movable shaft engaged with the second release cable for moving the second release cable. The linkage assembly may include one or more respective apertures for insertion and retention of each of the first and second cables. The linkage assembly may be spring biased towards the second release cable to maintain the door latch in a latched configuration. The actuation signal may be provided by movement of an outside door handle, actuation of a switch adjacent the outside door handle, and/or a remote actuation unit, and other means known in the art. Additionally or alternatively, the first and second release cables may be joined together to substantially form a unitary cable. The linkage assembly may be connected to first and second locations of the unitary cable to unlatch the door latch by pulling the unitary cable in a direction away from the door latch.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE PREFERRED EMBODIMENTS

Figure 1:
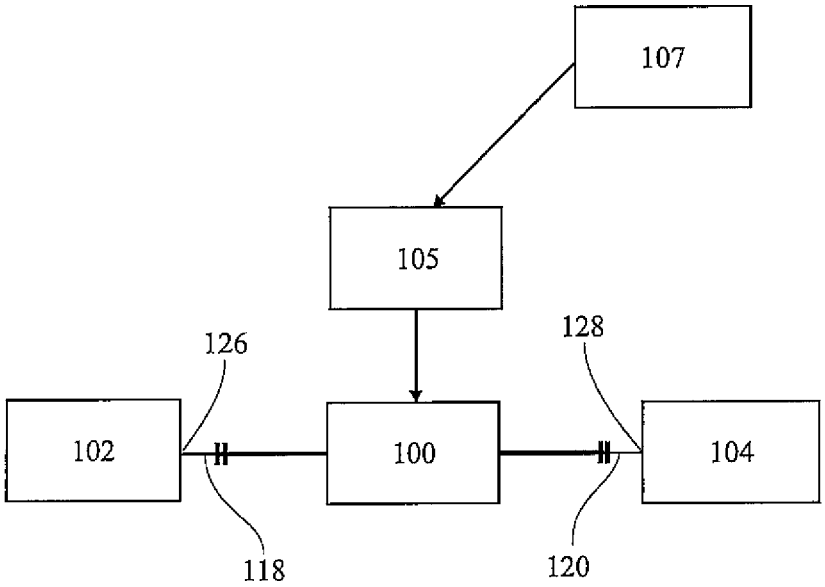
FIG. 1 is a diagram illustrative of the location of a door latch release system according to the present invention relative to a vehicle inside door handle and its corresponding door latch.

Referring now to the drawings wherein like reference numerals designate corresponding parts throughout the several views, FIGS. 1-5 illustrate a vehicle door latch release system according to the present invention, generally designated "door latch release system 100," and FIGS. 6-12 illustrate additional embodiments thereof.

As is known in the art, a conventional automobile door latch release system generally includes an inside door handle connected to a door release latch by means of a release cable, and further includes an outside door handle connected to the door release latch by means of a latch rod. As is also known in the art, in order to open a conventional vehicle door from the outside, the door must first be unlocked and thereafter opened by, for example, the outside door handle. Further, in order to open a conventional vehicle door from the inside, for vehicles with a lock over-ride feature, the inside door handle may be used to open the door with or without the lock engaged. For vehicles which do not have such a lock over-ride feature for the inside door (i.e. for a rear door), the door must first be unlocked and thereafter opened by the inside door handle. The present invention may therefore be used with vehicles including a lock over-ride feature for the interior door handle, for vehicles for which a latch release cable may be pulled to unlock a door, as well as for vehicles for which a latch release cable may be pulled for opening a latch or other functions.

Referring to FIG. 1, the present invention generally provides door latch release system 100 disposed at an intermediate location between a vehicle door inside handle 102 and its corresponding release latch 104 (or lock). Door latch release system 100 may be controlled by an electronic control unit 105 which actuates system 100 upon receiving a signal from a source 107, such as upon movement of an outside door handle (not shown), actuation of a switch (not shown) adjacent the outside door handle, a remote actuation unit (not shown), or by means of another source or method for providing an actuation signal.

Figure 2:
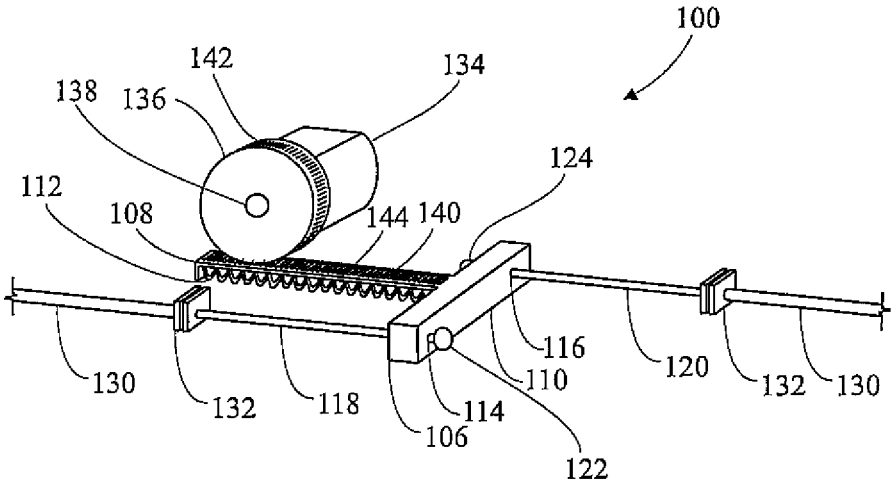
FIG. 2 is an isometric view of the door latch release system of FIG. 1, illustrating the system in a rest configuration.

In greater detail, referring to FIGS. 1 and 2, door latch release system 100 may generally include a movable linkage assembly 106 being formed as an elongated structure having a longitudinal arm 108 and an integrally formed cross-bar 110. As readily evident to those skilled in the art in view of this disclosure, a variety of other structures may be used for assembly 106 without departing from the scope of the present invention. Arm 108 may include a return spring 112 mounted therewith for maintaining release latch 104 in a latched configuration. In the embodiment illustrated, spring 112 may be a coil spring, but other biasing means known in the art may be used instead. Cross-bar 110 may include respective first and second apertures 114, 116 for permitting insertion and retention of respective first and second release cables 118, 120. In the embodiment illustrated, each release cable 118, 120 may include respective end retainers 122, 124 formed as enlarged rounded knobs for retention of the cables within the respective apertures of cross-bar 110. Further, cables 118, 120 may be respectively connected to inside door handle 102 and release latch 104 at their respective opposite ends 126, 128. Cables 118, 120 may also each include a sleeve 130 with an enlarged end-piece 132 for permitting sliding movement of the cables within each sleeve, as well as for limiting movement of the cables in the direction away from linkage assembly 106.

Referring to FIGS. 2-5, in the particular embodiment illustrated, a motor 134 may be used to move linkage assembly 106 in the direction of arrow-A by means of a pinion 136 mounted on shaft 138 thereof, with the pinion being engageable with a rack 140 formed on or otherwise connected to arm 108 of assembly 106. As evident to those skilled in the art, respective teeth 142, 144 of pinion 136, rack 140 may be formed and dimensioned for permitting rapid movement of assembly 106 in the direction of arrow-A, per the time-constraints discussed below.

Figure 3:
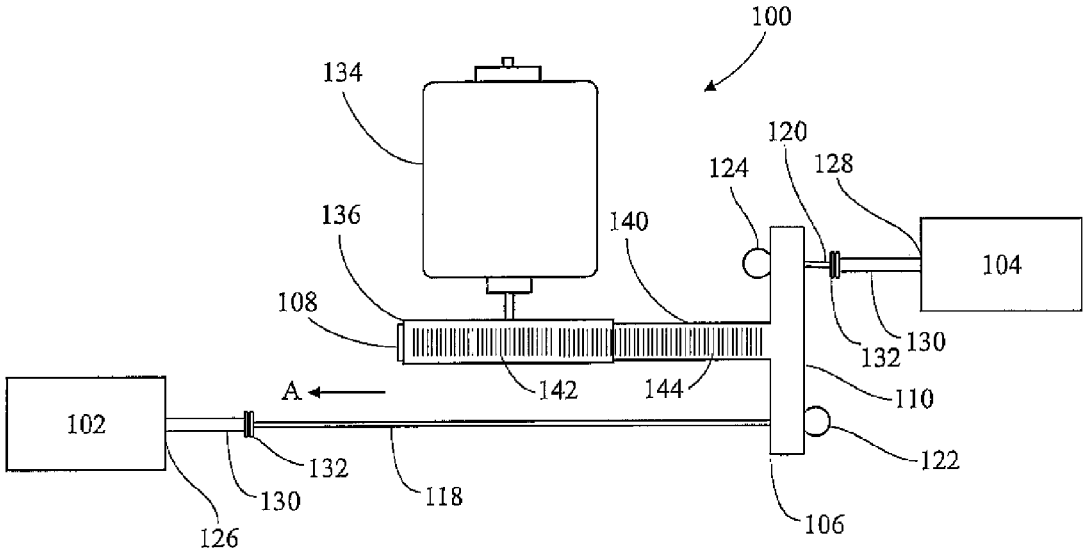
FIG. 3 is a top view of the door latch release system of FIG. 1, illustrating the system in a rest configuration.
Figure 4:
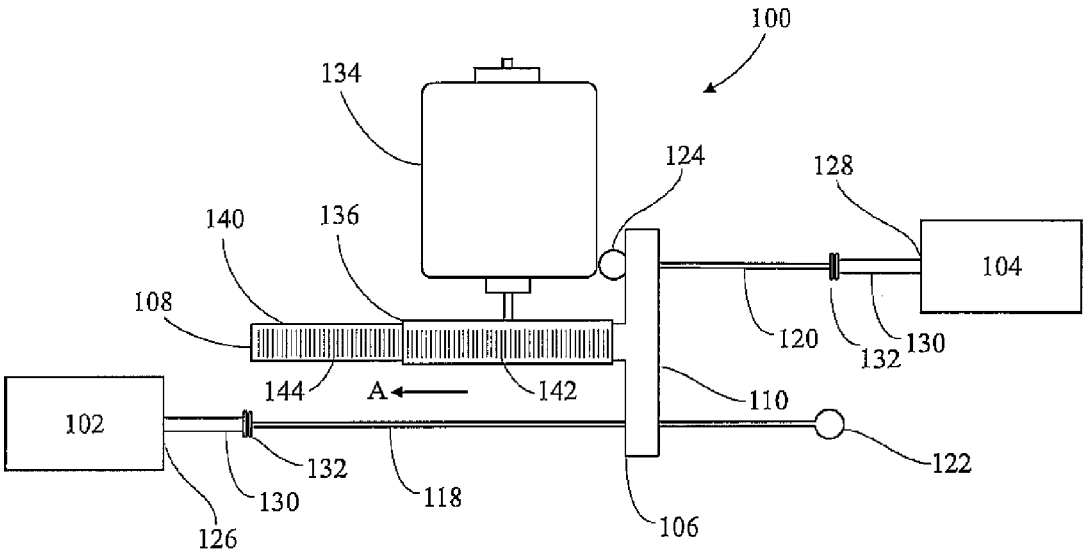
FIG. 4 is a top view of the door latch release system of FIG. 1, illustrating the system in an operational configuration by means of an actuation signal.

In operation, as shown in FIGS. 3 and 4, as a user having, for example, a remote access unit (i.e. source 107) approaches the vehicle having the door latch release system 100 mounted therein, an actuation signal may be sent to electronic control unit 105. Electronic control unit 105 may thus energize, for example, within a time interval of less than 10 ms, and verify signal authenticity, for example, within a time interval of less than 100 ms. If authentication fails, electronic control unit 105 may simply prevent energizing of motor 134. If the signal is authentic, electronic control unit 105 may energize motor 134 to rotate shaft 138 and pinion 136 therewith for moving linkage assembly 106 in the direction of arrow-A, for example, in less than 50 ms. In this manner, linkage assembly 106 may pull release cable 120 to unlatch door latch 104, and thus enable opening of the vehicle door (not shown) in a seamless manner in less than 140 ms from energizing of electronic control unit 105 and opening of the vehicle door. As shown in FIG. 4 particularly, release cable 118 may remain in its original position since it is only moved when inside door handle 102 is pulled.

Figure 5:
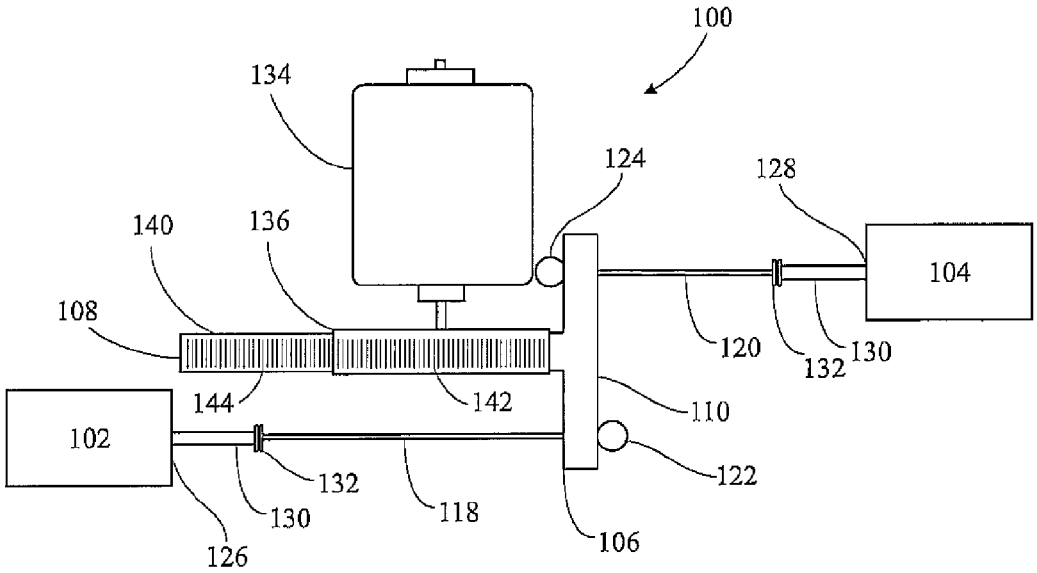
FIG. 5 is a top view of the door latch release system of FIG. 1, illustrating the system in an operational configuration by means of an inside handle.

Referring to FIGS. 2 and 5, compared to FIG. 4, when inside door handle 102 is pulled by an occupant to open the vehicle door, release cable 118 may pull linkage assembly 106, and therewith release cable 120 to unlatch door latch 104. Thus the present invention allows for unhindered operation of a vehicle door by means of the door latch release system 100 when a user approaches the vehicle from the outside via a remote access unit (i.e. source 107), or alternatively from the inside when a user simply pulls inside door handle 102 to unlatch door latch 104 in a known manner.

In a modification to door latch release system 100*a*, the first and second release cables 118*a*, 120*a* may be joined together to substantially form a unitary cable 1000. For this configuration, linkage assembly 106*a* may be connected to a first location 1002 and a second location 1004 of the unitary cable 1000 to unlatch door latch 104*a* by pulling the unitary cable 1000 in a direction away from the door latch 104*a*.

Figure 6:
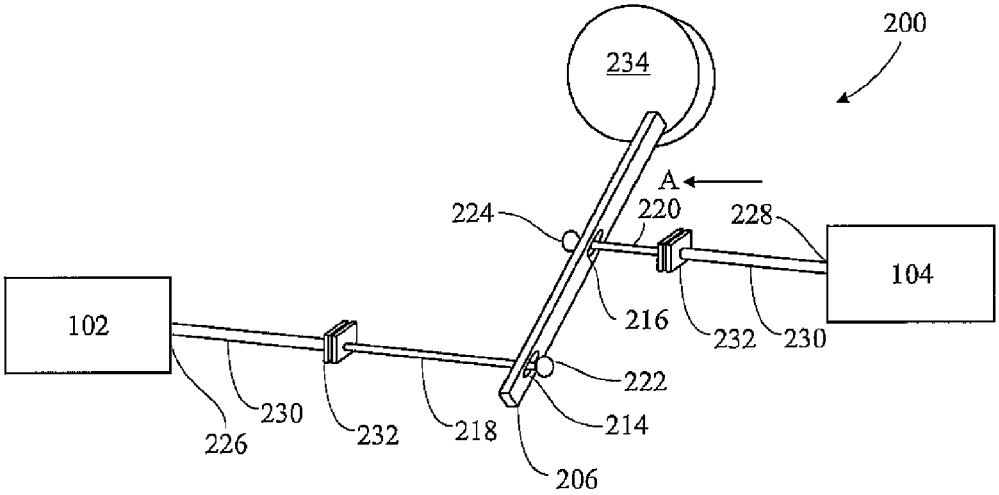
FIG. 6 is an isometric view of another embodiment of a door latch release system according to the present invention using a solenoid, illustrating the system in a rest configuration.
Figure 5A:
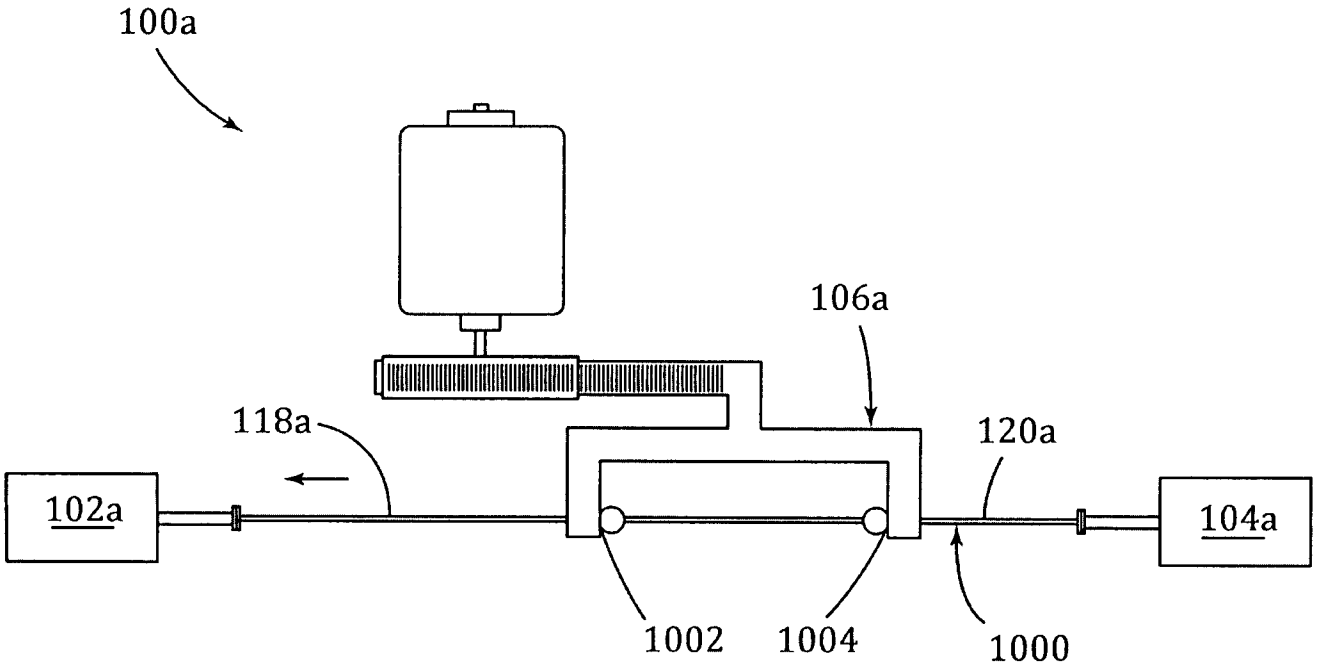
FIG. 5A is a top view of a modification to the door latch release system of FIG. 1, illustrating the system in a rest configuration.
Figure 7:
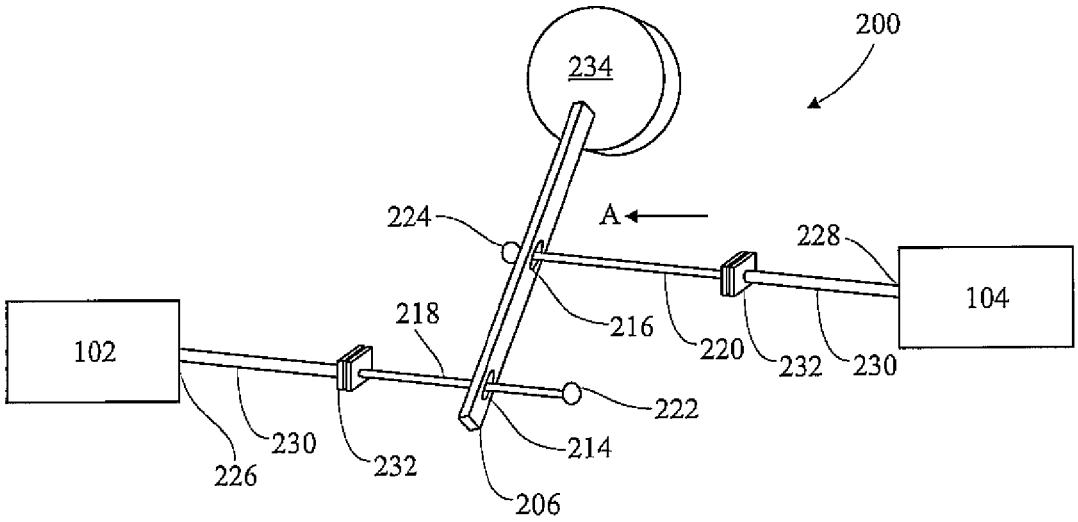
FIG. 7 is an isometric view of the door latch release system of FIG. 6, illustrating the system in an operational configuration by means of an actuation signal.
Figure 8:
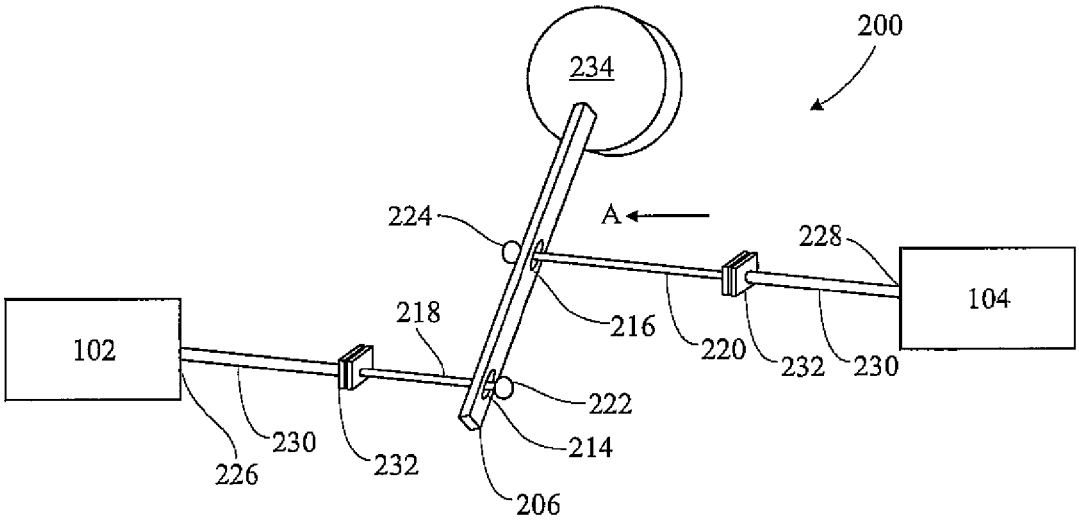
FIG. 8 is an isometric view of the door latch release system of FIG. 6, illustrating the system in an operational configuration by means of an inside door handle.

Referring next to FIGS. 6-8, another embodiment of the present invention is illustrated.

Specifically, as shown in FIG. 6, there is disclosed an alternative embodiment of a door latch release system 200 (which replaces system 100) disposed at an intermediate location between a vehicle door inside handle 102 (see FIG. 1) and its corresponding release latch 104 (see FIG. 1). As discussed above for door latch release system 100, system 200 may likewise be controlled by an electronic control unit 105 (see FIG. 1) which actuates system 200 upon receiving a signal from source 107 (see FIG. 1), such as upon movement of an outside door handle (not shown), actuation of a switch (not shown) adjacent the outside door handle, and/or a remote actuation unit (not shown). Door latch release system 200 may generally include a movable linkage assembly 206 formed as an elongated plate or rod shaped structure having respective first and second apertures 214, 216 for permitting insertion and retention of respective first and second release cables 218, 220 (in a similar manner as cables 118, 120). In the embodiment illustrated, each release cable 218, 120 may include respective end retainers 222, 224 formed as enlarged rounded knobs for retention of the cables within the respective apertures of assembly 206. Further, cables 218, 220 may be respectively connected to inside door handle 102 (similar to FIG. 1) and release latch 104 (similar to FIG. 1) at their respective opposite ends 226, 228. Cables 218 and 220 may also include a sleeve 230 with an enlarged end-piece 232 for permitting sliding movement of the cables within each sleeve, as well as for limiting movement of the cables in the direction away from linkage assembly 206.

Referring to FIGS. 6-8, in the particular embodiment illustrated, instead of motor 134 as used in FIG. 2, a rotary solenoid 234 may be used to move linkage assembly 206 in the direction of arrow-A by rotating the assembly.

In operation, as shown in FIGS. 1, 6 and 7, as a user having, for example, a remote access unit (i.e. source 107; see FIG. 1) approaches a vehicle having the door latch release system 200 mounted therein, an actuation signal may be sent to electronic control unit 105 (see FIG. 1). Electronic control unit 105 may thus energize, for example, within a time interval of less than 10 ms, and verify signal authenticity, for example, within a time interval of less than 100 ms. If authentication fails, electronic control unit 105 may simply prevent energizing of rotary solenoid 234. If the signal is authentic, electronic control unit 105 may energize rotary solenoid 234 for moving linkage assembly 206 in the direction of arrow-A, for example, in less than 50 ms. In this manner, linkage assembly 206 may pull release cable 220 to unlatch door latch 104, and thus enable opening of the vehicle door (not shown) in a seamless manner in less than 140 ms. As shown in FIG. 7 particularly, release cable 218 may remain in its original position since it is only moved when inside door handle 102 is pulled.

Referring to FIGS. 6 and 8, compared to FIG. 7, when inside door handle 102 is pulled, release cable 218 pulls linkage assembly 206, and therewith release cable 220 to unlatch door latch 104. It should be noted that release cable 220 may be pulled with the assistance of rotary solenoid 234.

Thus as with the embodiments of FIGS. 1-5, the embodiment of FIGS. 6-8 allows for unhindered operation of the vehicle door via door latch release system 200 when a user approaches the vehicle from the outside via a remote access unit, or alternatively from the inside when a user simply pulls inside door handle 102 to unlatch door latch 104 in a known manner.

Figure 9:
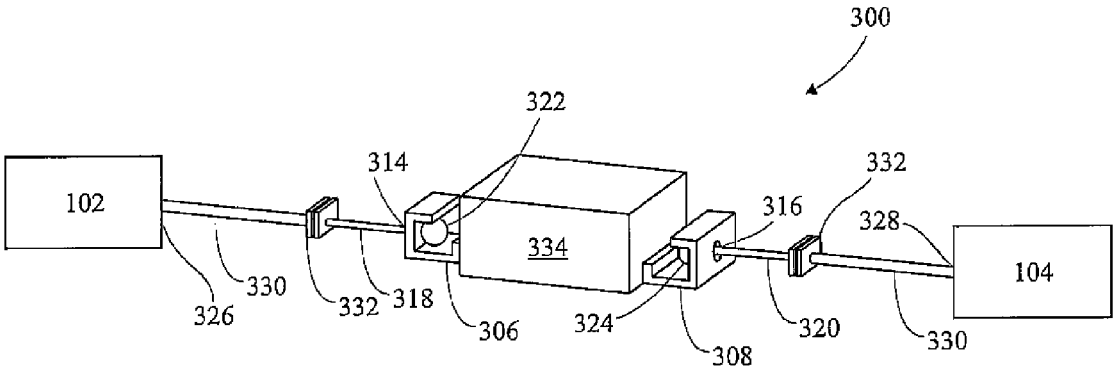
FIG. 9 is an isometric view of another embodiment of a door latch release system according to the present invention, also using a solenoid, and illustrating the system in a rest configuration.

Referring next to FIG. 9, another embodiment of the present invention is illustrated.

Specifically, as shown in FIG. 9, there is disclosed an alternative embodiment of a door latch release system 300 (which replaces system 100) disposed at an intermediate location between a vehicle door inside handle 102 (see FIG. 1) and its corresponding release latch 104 (see FIG. 1). As discussed above for door latch release system 100, system 300 may be controlled by an electronic control unit 105 (see FIG. 1) which actuates system 300 upon receiving a signal from source 107 (see FIG. 1), such as upon movement of an outside door handle (not shown), actuation of a switch (not shown) adjacent the outside door handle, and/or a remote actuation unit (not shown). Door latch release system 300 may generally include links 306, 308 connected to opposite ends thereof, with each link including respective first and second apertures 314, 316 for permitting insertion and retention of respective first and second release cables 318, 320 (similar to cables 118, 120). In the embodiment illustrated, each release cable 318, 320 may include respective end retainers 322, 324 formed as enlarged rounded knobs for retention of the cables within the respective apertures of links 306, 308. Further, cables 318, 320 may be respectively connected to inside door handle 102 (similar to FIG. 1) and release latch 104 (similar to FIG. 1) at their respective opposite ends 326, 328. Cables 318, 320 may also each include a sleeve 330 with an enlarged end-piece 332 for permitting sliding movement of the cables within each sleeve, as well as for limiting movement of the cables in the direction away from links 306, 308. In the particular embodiment illustrated in FIG. 9, instead of motor 134 as in FIG. 2, a solenoid 334 may be used to pull link 308.

In operation, as shown in FIGS. 1 and 9, as a user having, for example, a remote access unit (i.e. source 107) approaches the vehicle having the door latch release system 300 mounted therein, an actuation signal may be sent to electronic control unit 105 (see FIG. 1). Electronic control unit 105 may thus energize, for example, within a time interval of less than 10 ms, and verify signal authenticity, for example, within a time interval of less than 100 ms. If authentication fails, electronic control unit 105 may simply prevent energizing of solenoid 334. If the signal is authentic, electronic control unit 105 may energize solenoid 334 for pulling link 308, for example, in less than 50 ms. In this manner, link 308 may pull release cable 320 to unlatch door latch 104, and thus enable opening of the vehicle door (not shown) in a seamless manner in less than 140 ms.

Referring to FIG. 9, when inside door handle 102 is pulled, release cable 318 may pull link 306, and therewith release cable 320 to unlatch door latch 104.

Thus as with the embodiments of FIGS. 1-5, the embodiment of FIG. 9 allows for unhindered operation of the door latch via door latch release system 300 when a user approaches the vehicle from the outside via a remote access unit, or alternatively from the inside when a user simply pulls inside door handle 102 to unlatch door latch 104 in a known manner.

Figure 10:
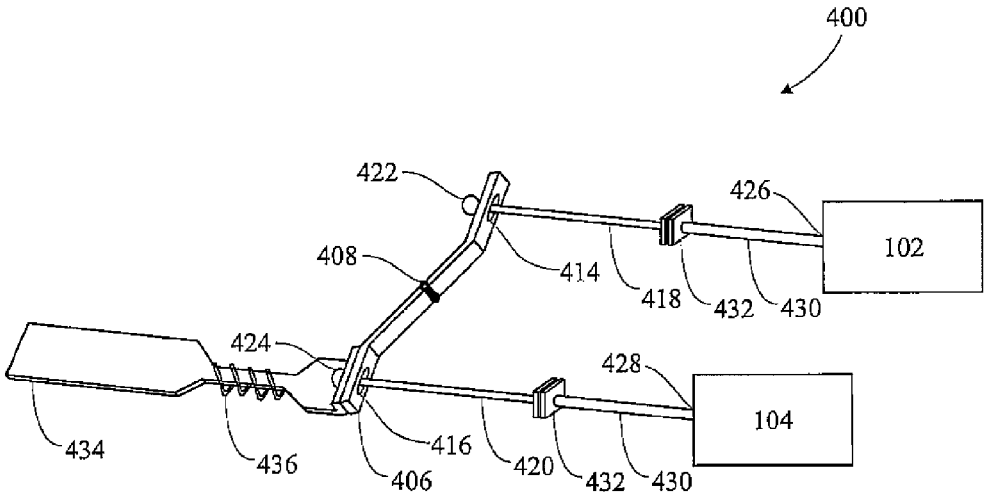
FIG. 10 is an isometric view of another embodiment of a door latch release system according to the present invention using a linear actuator, illustrating the system in a rest configuration.
Figure 11:
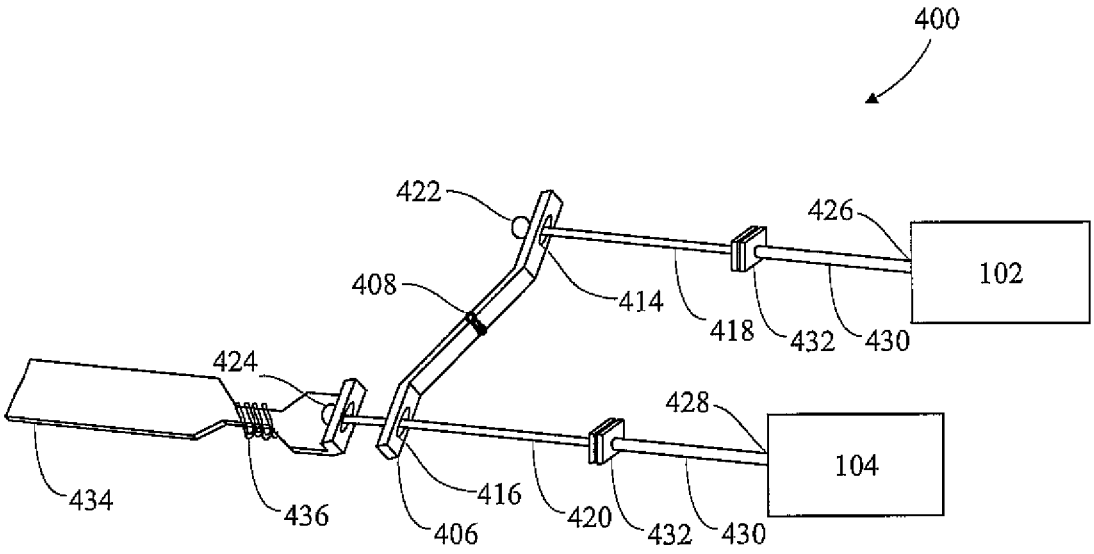
FIG. 11 is an isometric view of the door latch release system of FIG. 10, illustrating the system in an operational configuration by means of an actuation signal.
Figure 12:
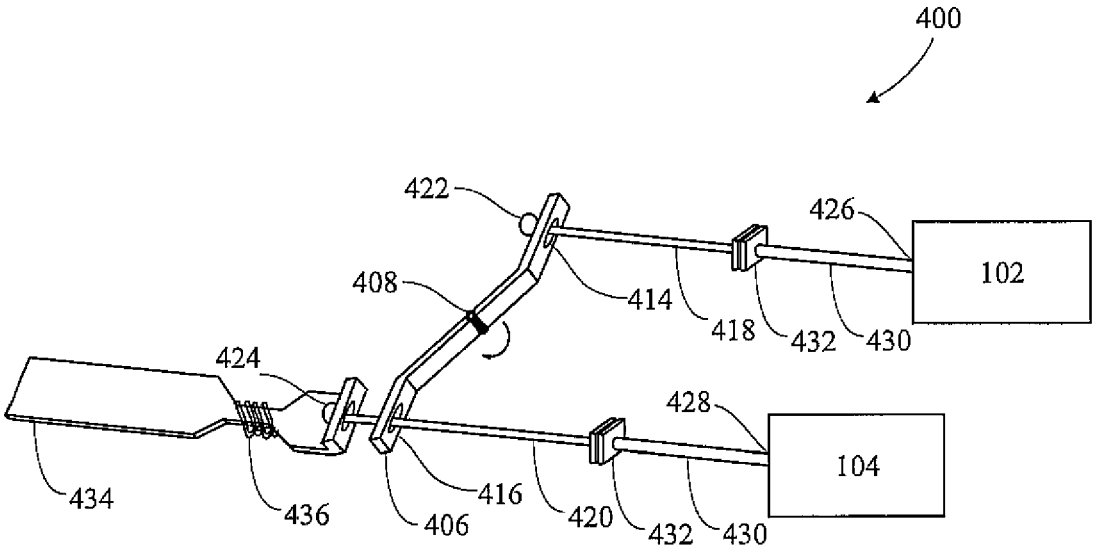
FIG. 12 is an isometric view of the door latch release system of FIG. 10, illustrating the system in an operational configuration by means of an inside door handle.

Referring next to FIGS. 10-12, another embodiment of the present invention is illustrated.

Specifically, as shown in FIG. 10, there is disclosed an alternative embodiment of a door latch release system 400 (which replaces system 100) disposed at an intermediate location between a vehicle door inside handle 102 (see FIG. 1) and its corresponding release latch 104 (see FIG. 1). As discussed above for door latch release system 100, system 400 may be controlled by an electronic control unit 105 (see FIG. 1) which actuates system 400 upon receiving a signal from a source 107 (see FIG. 1), such as upon movement of an outside door handle (not shown), actuation of a switch (not shown) adjacent the outside door handle, and/or a remote actuation unit (not shown). Door latch release system 400 may generally include a pivotable linkage assembly 406 being formed as an elongated structure having respective first and second apertures 414, 416 for permitting insertion and retention of respective first and second release cables 418, 420 (similar to cables 118, 120). In the embodiment illustrated, each release cable 418, 420 may include respective end retainers 422, 424 formed as enlarged rounded knobs for retention of the cables within the respective apertures of assembly 406. Further, cables 418, 420 may be respectively connected to inside door handle 102 (similar to FIG. 1) and release latch 104 (similar to FIG. 1) at their respective opposite ends 426, 428. Cables 418 and 420 may also include a sleeve 430 with an enlarged end-piece 432 for permitting sliding movement of the cables within each sleeve, as well as for limiting movement of the cables in the direction away from linkage assembly 406. Referring to FIG. 10, in the particular embodiment illustrated, instead of motor 134 as in FIG. 2, a linear actuator 434 may be used to pull cable 420. Actuator 434 may include a spring 436 for biasing linkage assembly 406, which is pivotable about pivot 408, and thus maintains cable 420 in the latched configuration of FIG. 10.

In operation, as shown in FIGS. 10 and 11, as a user having, for example, a remote access unit (i.e. source 107) approaches the vehicle having the door latch release system 400 mounted therein, an actuation signal may be sent to electronic control unit 105. Electronic control unit 105 may thus energize, for example, within a time interval of less than 10 ms, and verify signal authenticity, for example, within a time interval of less than 100 ms. If authentication fails, electronic control unit 105 may simply prevent energizing of linear actuator 434. If the signal is authentic, electronic control unit 105 may energize linear actuator 434 for pulling cable 120, for example, in less than 50 ms. In this manner, linkage assembly 406 may pull release cable 420 to unlatch door latch 104, and thus enable opening of the vehicle door (not shown) in a seamless manner in less than 140 ms. As shown in FIG. 11, release cable 418 may remain in its original position since it is only moved when inside door handle 102 is pulled.

Referring to FIGS. 10 and 12, compared to FIG. 11, when inside door handle 102 is pulled, release cable 418 may rotate linkage assembly 406 about pivot 408 in a clock-wise direction as shown in FIG. 12, and therewith, with the assistance of linear actuator 434 (i.e. by sending a signal to actuator 434 upon pulling of door handle 102), pull release cable 420 to unlatch door latch 104.

Thus as with the embodiments of FIGS. 1-5, the embodiment of FIGS. 10-12 allows for unhindered operation of the door latch via door latch release system 400 when a user approaches the vehicle from the outside via a remote access unit, or alternatively from the inside when a user simply pulls inside door handle 102 to unlatch door latch 104 in a known manner.

It should be noted that while the door latch release systems described above have been described for unlatching a door latch 104, the latch release systems may likewise be used with vehicles for which the pulling of a release cable (such as cable 120; see FIG. 2) only unlocks the door without releasing the latch (i.e. for rear doors). Those skilled in the art would further readily appreciate in view of this disclosure that the principles of the present invention may be readily applied in either case which allows a door to be only unlocked or a latch to be released (as discussed above) as long as the unlatching or unlocking (or yet another function) requires the pulling of a release cable.

To summarize, the door latch release systems described above are beneficial in that they can be used with existing latching systems with over-ride, as well as with latching (or unlocking) systems which utilize a release cable. The noted systems prevent costly development of new passive entry side door latches, and work independently of the electronic control unit to thus allow for independent design, installation, operation and maintenance of the systems. The systems may also be implemented with minimal change of an internal door structure, thus avoiding the implementation of expensive and complex passive door latch release systems.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A vehicle including a passive entry side door latch release system engaged with a first release cable connected to an inside door handle and with a second release cable connected to a door latch, said door latch release system comprising:

a movable linkage assembly engaged with said first and second release cables;

means for moving said linkage assembly to pull said second release cable to unlatch said door latch; and a controller for controlling said means for moving;

wherein said controller operates said means for moving upon receiving an actuation signal wherein said first and second release cables are joined together to substantially form a unitary cable with the first and second release cables shifting by an equal amount upon movement of the inside door handle, said linkage assembly is connected to first and second locations of said unitary cable to unlatch said door latch by pulling said unitary cable in a direction away from said door latch.

2. A vehicle including a passive entry side door latch release system engaged with a first release cable connected to an inside door handle and with a second release cable connected to a door latch, said door latch release system comprising:

a movable linkage assembly engageable with the first and second release cables;

a motor including an output shaft having a pinion engageable with a rack affixed to or formed with the movable linkage assembly to pull the second release cable to unlatch the door latch; and an electronic control unit for controlling the motor;

wherein the electronic control unit operates the motor upon receiving an actuation signal; and wherein the first and second release cables are joined together to substantially form a unitary cable with the first and second release cables shifting by an equal amount upon movement of the inside door handle, the linkage assembly is connected to first and second locations of the unitary cable to unlatch the door latch by pulling the unitary cable in a direction away from the door latch.

3. A vehicle side door entry system comprising:

a vehicle door having a door latch having a first release member defining an elongated axis forming a first line connected thereto and a door handle having a second release member defining an elongated axis forming a second line connected thereto; and a passive entry side door latch release system comprising a movable linkage assembly engageable with the release members, a motor engaged with the linkage assembly to linearly move the linkage assembly along the first and second lines to pull the first release member to unlatch the door latch, and an electronic control unit for controlling the motor, the electronic control unit operating the motor upon receiving an actuation signal;

the second release member being engaged with the linkage assembly to linearly move the linkage assembly along the first and second lines to pull the first release member via the linkage assembly to unlatch the door latch upon actuation of the door handle.

4. The vehicle side door entry system of claim 3, wherein:

the linkage assembly includes at least one aperture for insertion and retention of the release members.

5. The vehicle side door entry system of claim 3, wherein:

the linkage assembly is spring biased towards the second release member to maintain the door latch in a latched configuration.

6. The vehicle side door entry system of claim 3, wherein:

the motor includes an output shaft having a pinion engageable with a rack affixed to or formed with the linkage assembly for pulling the first release member.

7. The vehicle side door entry system of claim 3, wherein:

the actuation signal is provided by at least one of movement of the door handle, actuation of a switch adjacent the door handle, and a remote actuation unit.

8. The vehicle side door entry system of claim 3, wherein:

the first release member moves along a first line;

the second release member moves along a second line; and the first line and the second line are not co-linear.

9. The vehicle side door entry system of claim 3, wherein:

at least one of the first release member and the second release member extend through the movable linkage assembly.

10. The vehicle side door entry system of claim 9, wherein:

both the first release member and the second release member extend through the movable linkage assembly.

11. A vehicle including doors leading to a compartment, at least one of the doors including a latch having a first member that moves along a first line and a handle having a second member that moves along a second line, and a linkage assembly engageable with the members, the linkage assembly moving linearly to pull the first member along the first line to unlatch the latch, with the linkage assembly moving along the first and second lines via actuation of a motor engaged with the linkage assembly or via being pulled by the second member, and wherein the first and second members shift an equal amount upon movement of the handle.

12. A vehicle comprising:

a linkage assembly engageable with first and second members connected to a latch and a handle, respectively; and a motor to unlatch the latch;

the linkage assembly is connected to the members and unlatches the latch by pulling the first member, with the linkage assembly being actuated to move linearly along a straight line to pull the first member via actuation of the motor or by being pulled by the second member.

* * * * *